US005348442A

United States Patent [19]

Harris et al.

[11] Patent Number: 5,348,442

[45] Date of Patent: Sep. 20, 1994

[54] TURBINE PUMP

[75] Inventors: David E. Harris, Bridgeport; Brian J. Christopher, Clio; Cary W. Rackett, Goodrich, all of Mich.

[73] Assignee: General Motors Corporation, Detroit, Mich.

[21] Appl. No.: 107,879

[22] Filed: Aug. 18, 1993

[51] Int. Cl.[5] ..... F04D 5/00

[52] U.S. Cl. ..... 415/55.1

[58] Field of Search ..... 415/55.1, 55.2, 55.3, 415/55.4, 55.5

[56] References Cited

U.S. PATENT DOCUMENTS

| | | | |
|---|---|---|---|
| 3,836,291 | 9/1974 | Bottcher et al. | 417/423 |
| 3,881,839 | 5/1975 | MacManus | 415/53 |
| 4,205,947 | 6/1980 | Ruhl et al. | 417/199 |
| 4,508,492 | 4/1985 | Kusakawa et al. | 415/55.1 |
| 4,586,877 | 5/1986 | Watanabe et al. | 415/55.1 |
| 4,591,311 | 5/1986 | Matsuda et al. | 415/53 |
| 4,653,979 | 3/1987 | Schillinger | 415/53 |
| 4,692,092 | 9/1987 | Matsuda et al. | 415/55.1 |
| 4,734,008 | 3/1988 | Roth | 415/53 |
| 4,793,766 | 12/1988 | Kumata | 415/53 |
| 5,192,184 | 3/1993 | Nobuo et al. | 415/55.1 |

FOREIGN PATENT DOCUMENTS

| | | | |
|---|---|---|---|
| 1080858 | 4/1960 | Fed. Rep. of Germany | 415/55.1 |
| 60892 | 5/1981 | Japan | 415/55.1 |
| 199693 | 8/1991 | Japan | 415/55.1 |
| 44444 | 11/1938 | Netherlands | 415/55.1 |
| 2239487 | 7/1991 | United Kingdom | 415/55.1 |

*Primary Examiner*—John T. Kwon

*Attorney, Agent, or Firm*—Saul Schwartz

[57] ABSTRACT

An open-vane regenerative turbine pump includes a housing, an impeller rotatably supported on the housing having a plurality of paddle-like open-vane type vanes thereon, an annular pump channel in the housing around the periphery of the impeller and around the vanes, a stripper in the pump channel between an inlet port of the latter and a discharge port thereof, and a pair of bosses on the housing in the pump channel on opposite sides of the impeller about midway between the inlet and discharge ports. The bosses each have an edge obstructing a radially inner fraction of the pump channel to intercept inertially separated vapor in the inner fraction having a velocity component in the direction of rotation of the impeller. A pair of notches are formed in the housing adjacent respective ones of the bosses in flow communication with a vapor collection chamber and with a radially innermost extremity of the pump channel. The momentum of the intercepted vapor induces flow thereof through the notches to the vapor collection chamber for maximum scavenging of vapor from the pump channel.

4 Claims, 2 Drawing Sheets

TURBINE PUMP

FIELD OF THE INVENTION

This invention relates to open-vane regenerative turbine pumps.

BACKGROUND OF THE INVENTION

U.S. Pat. No. 3,881,839, issued May 6, 1975 and assigned to the assignee of this invention, describes an electric fuel pump assembly which operates submerged in fuel in a fuel tank of a motor vehicle and which includes an open-vane regenerative turbine pump. A plurality of paddle-like radial vanes on a rotating impeller of the pump induce fluid flow in a pump channel defined by an annular groove in a housing of the pump around the periphery of the impeller. Vapor which is inertially separated from liquid fuel in the pump channel is expelled therefrom through bleed holes in the pump housing near the radially innermost extremity of the pump channel. In an open-vane regenerative turbine pump of an electric fuel pump assembly described in U.S. Pat. No. 3,418,991, issued Dec. 31, 1968 and assigned to the assignee of this invention, predetermined lateral clearance between the pump housing and the sides of the impeller defines elongated vapor bleed slots on opposite sides of the impeller at the radially innermost extremity of the pump channel through which inertially separated vapor is expelled. An open-vane regenerative turbine pump according to this invention has improved vapor scavenging characteristics relative to the open-vane regenerative turbine pumps described in the aforesaid U.S. Pat. Nos. 3,881,839 and 3,418,991.

SUMMARY OF THE INVENTION

This invention is a new and improved open-vane regenerative turbine pump for application in an electric fuel pump assembly operating submerged in fuel in a fuel tank of a motor vehicle. The regenerative turbine pump according to this invention includes an open-vane impeller having paddle-like vanes extending radially out from a ring-shaped body of the impeller, an annular groove in a housing of the pump defining a pump channel around the periphery of the impeller and the vanes, a stripper on the pump housing fitting close around the impeller between an inlet port of the pump channel and a discharge port of the pump channel, and a pair of bosses on the pump housing partially obstructing the pump channel on opposite sides of the impeller about midway between the inlet and the discharge ports. Inertially separated vapor in the pump channel having a velocity component in the direction of rotation of the impeller is intercepted and redirected radially inward by the bosses into a vapor collection chamber radially inboard of the pump channel through notches in the pump housing adjacent the bosses.

DESCRIPTION OF A PREFERRED EMBODIMENT

Figure 1:
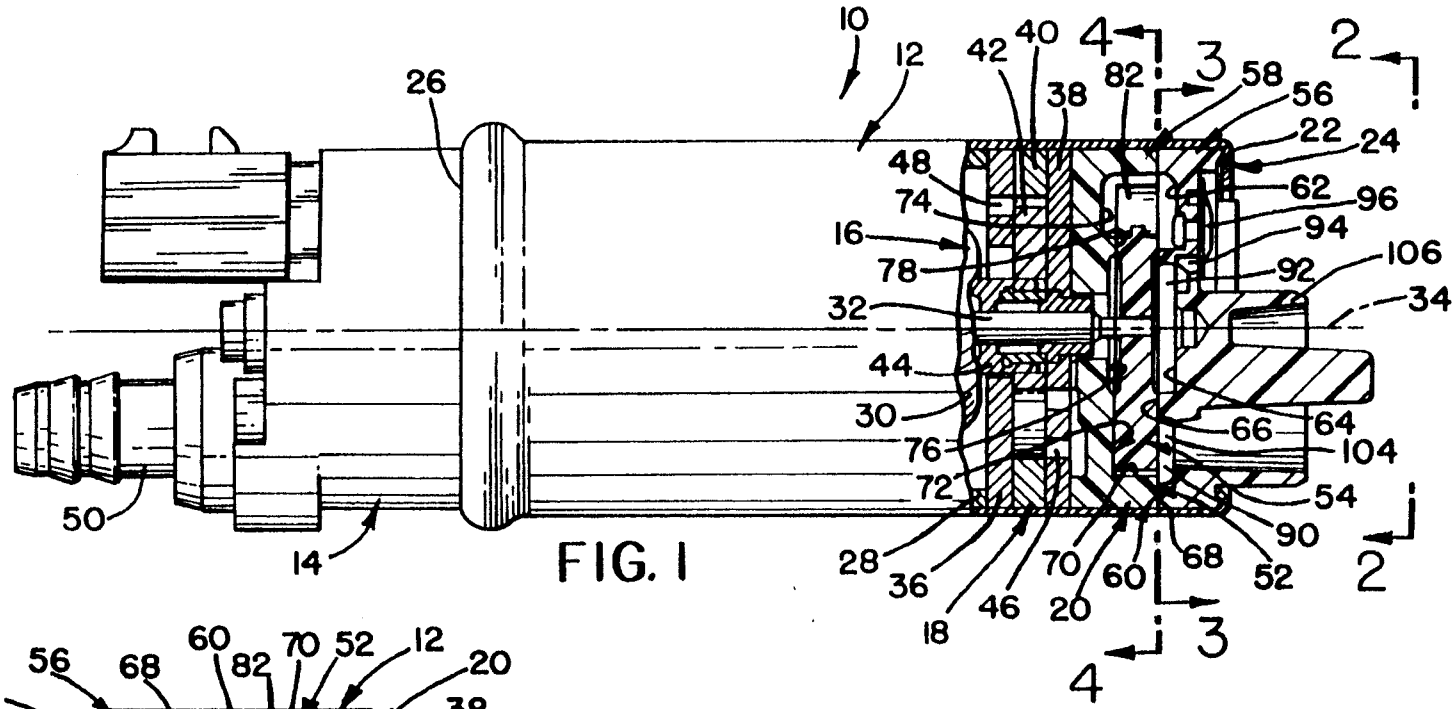
FIG. 1 is a fragmentary, partially broken-away view of an electric fuel pump assembly including an open-vane regenerative turbine pump according to this invention.

Referring to FIG. 1, an electric fuel pump assembly 10 adapted to operate submerged in fuel in a motor vehicle fuel tank, not shown, has a thin-walled tubular shell 12 enclosing an end housing 14, an electric motor 16, a roller vane pump 18, and an open-vane regenerative turbine pump 20 according to this invention. An annular lip 22 at an open first end 24 of the shell prevents dislodgement of the motor 16 and the pumps 18, 20 through the first end. The shell is magnaformed around a shoulder on the end housing 14 whereby a second end 26 of the shell is sealed closed and dislodgement of the end housing, the motor, and the pumps through the second end is prevented.

The electric motor 16 forms no part of this invention and includes, generally, a cylindrical flux carrier 28, field magnets, not shown, mounted on the flux carrier, and an armature 30 having a shaft 32 supported on the shell 12 by the end housing 14 and by the roller vane pump 18 for rotation about a longitudinal centerline 34 of the shell. The roller vane pump 18, which also forms no part of this invention, includes a first disc-shaped side plate 36, a second disc-shaped side plate 38, a cam ring 40 between the side plates, and a rotor 42 between the side plates 36, 38 inside the ring 40. The rotor has a plurality of outwardly opening roller pockets, not shown, with rollers therein bearing against the cam ring and cooperating therewith in well known fashion in defining variable volume pumping chambers.

The rotor 42 is rotated by the armature 30 through a driver 44 integral with the armature. When the electric motor is on, the pumping chambers between the rollers on the rotor pump fuel from an inlet port 46 of the roller vane pump in the side plate 38 to a discharge port 48 of the roller vane pump in the side plate 36. Fuel discharged from the discharge port 36 of the roller vane pump flows around the armature 30 and discharges from the fuel pump assembly through a tubular connector 50 on the end housing 14, FIG. 1.

The open-vane regenerative turbine pump 20 according to this invention includes a two-piece housing 52 and an open-vane impeller 54. The housing 52 is captured between the lip 22 on the shell 12 and the side plate 38 of the roller vane pump 18 and includes and outer disc 56 exposed to the fuel tank through the open first end 24 of the shell 12 and an inner disc 58 between the side plate 38 and the outer disc.

Figure 3:
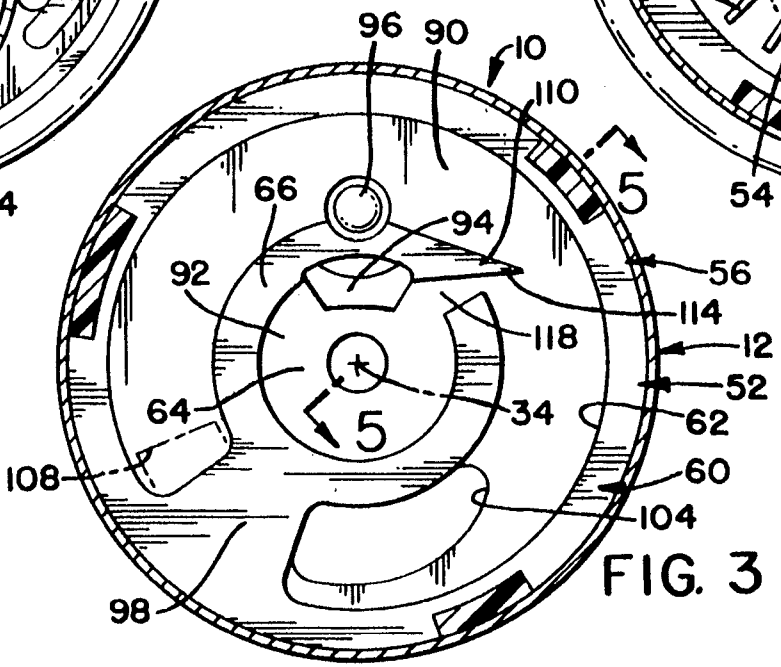
FIG. 3 is a sectional view taken generally along the plane indicated by lines 3—3 in FIG. 1.

A flat side 60 of the outer disc 56 perpendicular to the centerline 34 and facing the inner disc 58 has a shallow, substantially annular groove 62 therein around a similarly shallow circular spotface 64 in the flat side 60, FIGS. 1, 3. The portion of the outer disc 56 between the groove 62 and the spotface 64 defines an annular shoulder 66 in the plane of the flat side 60.

A flat side 68 of the inner disc 58 perpendicular to the centerline 34 and facing the flat side 60 on the outer disc has a cylindrical cavity therein including a side wall 70 symmetric about the centerline 34 and a flat bottom wall 72 in a plane perpendicular to the centerline 34. The bottom wall 72 has a shallow, substantially annular groove 74 therein around a similarly shallow circular spotface 76 in the bottom wall, FIGS. 1, 4 and 5. The groove 74 and spotface 76 are opposite the groove 62 and spotface 64 in the flat side 60 of the outer disc 56. The portion of the inner disc 58 between the groove 74 and the spotface 76 defines an annular shoulder 78 in the plane of the bottom wall 72 opposite the annular shoulder 66 on the outer disc.

Figure 5:
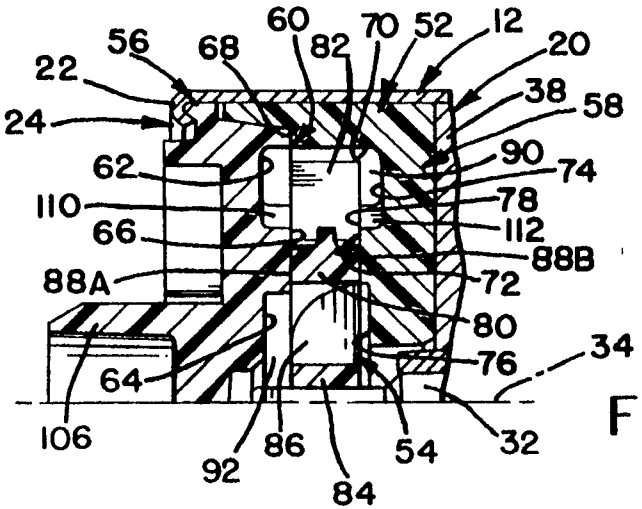
FIG. 5 is a sectional view taken generally along the planes indicated by lines 5—5 in FIGS. 3 and 4.
Figure 4:
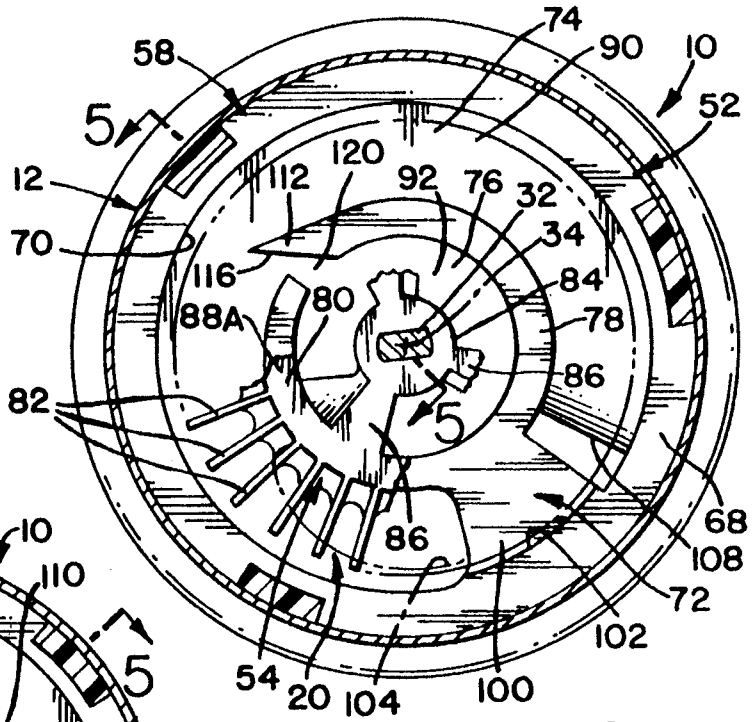
FIG. 4 is a sectional view taken generally along the plane indicated by lines 4—4 in FIG. 1.

As seen best in FIGS. 4 and 5, the open-vane impeller 54 is preferably made of molded plastic and includes a ring-shaped body 80, a plurality of paddle-like vanes 82 projecting radially out from the body 80, a hub 84, and a plurality of radial spokes 86 between the body 80 and the hub 84. The spokes 86 define a plurality of fan blades as described more fully in U.S. Pat. No. 4,734,008, issued Mar. 29, 1988 and assigned to the assignee of this invention. The ring-shaped body 80 has a pair of annular sides 88A–B in parallel planes. The "open-vane" designation for impeller 54 derives from the absence of webs between the vanes 82 reaching or extending to about the radially outermost extremities or tips of the vanes.

The impeller 54 is captured in the cavity between the inner and outer discs 58, 56 and connected to the armature shaft 32 at the hub 84 whereby the impeller 54 is rotatably driven about the centerline 34 by the electric motor 16 concurrently with the rotor 42 in the roller vane pump 18. The annular sides 88A–B of the body of the impeller 54 are closely adjacent the annular shoulders 66, 78 on the outer and inner discs 56, 58, respectively, so that the annular grooves 62, 74 and the side wall 70 of the cavity cooperate in defining an annular pump channel 90, FIG. 5, around the periphery of the impeller 54 and the vanes 82.

The spotfaces 64, 76 cooperate with the interstices between the spokes 86 of the impeller in defining a vapor collection chamber 92 of the pump 20 radially inboard of the pump channel. The vapor collection chamber is in flow communication with the fuel tank through a vapor discharge port 94 in the outer disc. A flexible umbrella valve 96 on the outer disc covers the vapor discharge port and prevents backflow from the fuel tank into the vapor collection chamber.

As seen best in FIGS. 1, 3 and 4, the annular groove 62 in the outer disc 56 is interrupted by a stripper 98 in the plane of the flat side 60. Likewise, the annular groove 74 in the bottom wall 72 of the cavity in the inner disc is interrupted by a stripper 100 opposite the stripper 98 in the plane of the bottom wall 72. The side wall 70 of the cavity in the inner disc has a reduced radius portion 102, FIG. 4, aligned with the strippers 98, 100 and defining a stripper closely adjacent the tips of the vanes 82.

Figure 2:
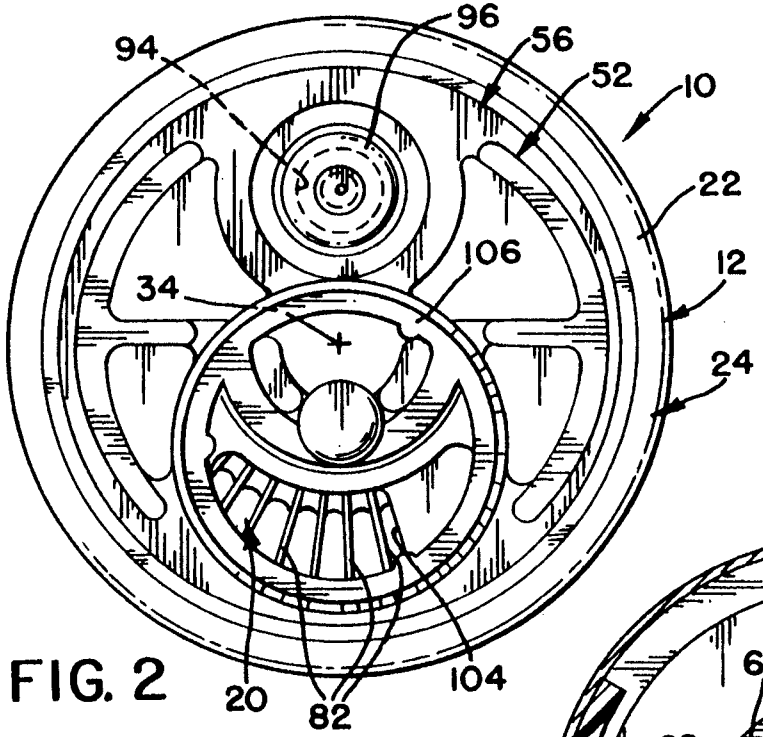
FIG. 2 is a view taken generally along the plane indicated by lines 2—2 in FIG. 1.

An inlet port 104 in the outer disc 56 adjacent one side of the stripper 98 affords flow communication between the fuel tank and the pump channel 90. On the side of the outer disc 56 facing the fuel tank, the inlet port 104 is surrounded by a cylindrical shoulder 106, FIGS. 1–2, where a screen may conveniently be attached. A discharge port 108 in the inner disc 58 adjacent the opposite side of the stripper 100 affords flow communication between the pump channel 90 and the inlet port 46 of the roller vane pump 18.

The pump channel 90 is partially obstructed on opposite sides of the impeller 54 about mid-way between the inlet and discharge ports 104, 108 by a first integral boss 110, FIGS. 3 and 5, on the outer disc 56 in the groove 62 and by a second integral boss 112, FIGS. 4 and 5, on the inner disc 58 in the groove 74 opposite the first integral boss. The first boss has a side surface closely adjacent the impeller 54 in the plane of the flat side 60 and an edge 114 facing opposite the direction of flow in the pump channel, i.e. toward the inlet port end of the pump channel, and obstructing a radially inner fraction of the pump channel on the corresponding side of the impeller. Similarly, the second boss has a side surface closely adjacent the impeller 54 in the plane of the bottom wall 72 and an edge 116 facing opposite the direction of flow in the pump channel and obstructing a radially inner fraction of the pump channel on the corresponding side of the impeller. The edges 114, 116 are inclined toward the inlet port end of the pump channel relative to a radius from the centerline 34.

As seen best in FIG. 3, a notch 118 in the outer disc 56 adjacent edge 114 of the boss 110 affords flow communication across the annular shoulder 66 between the innermost extremity of the pump channel 90 and the vapor collection chamber 92. As seen best in FIG. 4, a notch 120 in the inner disc 58 adjacent the edge 116 of the boss 112 affords flow communication across the annular shoulder 78 between the innermost extremity of the pump channel 90 and vapor collection chamber 92.

The pump 20 operates as follows. When the electric motor is on, the armature shaft 32 rotates the rotor 42 and the impeller 54 at about 5500 rpm. Fuel enters the pump channel 90 through the inlet port 104 and is pumped in well known regenerative turbine fashion by the impeller vanes 54 in the arc of the pump channel toward the discharge port 108. Vapor entering the pump channel with the liquid fuel, being less dense than the liquid fuel, is forced toward the radially innermost extremity of the pump channel as the mixture traverses the length of the channel from the inlet port to the discharge port.

Clearance between the annular shoulders 66, 78 and the corresponding sides 88A–B of the impeller body 80 define a pair of elongated vapor bleed orifices on opposite sides of the impeller through which inertially separated vapor enters the vapor collection chamber 92. Concurrently, vapor in the radially inner fraction of the pump channel 90 obstructed by the edges 114, 116 and having a velocity component in the direction of rotation of the impeller 54, impinges on the edges 114, 116 on opposite sides of the impeller. The edges 114, 116 redirect the velocity component of the vapor radially inward so that momentum induces flow of the intercepted vapor into the vapor collection chamber 92 through the notches 118, 120. The bosses, therefore, maximize scavenging of vapor from the pump channel so that only substantially vapor-free liquid fuel is delivered to the inlet port 46 of the roller vane pump.

The embodiments of the invention in which an exclusive property or privilege is claimed are defined as follows:

1. In an open-vane regenerative turbine pump including a housing, an impeller having a body and a plurality of paddle-like open-vane type vanes extending radially out from said body, means rotatably mounting said impeller on said housing, means on said housing defining an annular pump channel around the periphery of said impeller and around said vanes, means on said housing defining a stripper in said pump channel closely adjacent said impeller, means on said housing defining an inlet port to said pump channel closely adjacent a first side of said stripper and a discharge port from said pump channel closely adjacent a second side of said stripper, and means on said housing defining a vapor collection chamber radially inboard of said pump channel, the improvement comprising:

means defining a pair of bosses on said housing in said pump channel on opposite sides of said impeller each having an edge obstructing a radially inner fraction of said pump channel for intercepting vapor in said radially inner fraction of said pump channel having a velocity component in the direction of rotation of said impeller, and means defining a pair of notches in said housing each in flow communication with said vapor collection chamber and with a radially innermost extremity of said pump channel and each located closely adjacent a respective one of said pair of bosses on said housing whereby the momentum of said intercepted vapor induces flow of said intercepted vapor through said notches to said vapor collection chamber.

2. The open-vane regenerative turbine pump recited in claim 1 wherein:

each of said bosses is located on said housing about midway between said inlet port and said discharge port.

3. The open-vane regenerative turbine pump recited in claim 2 wherein:

each of said pair of bosses is integral with said housing.

4. The open-vane regenerative turbine pump recited in claim 3 wherein:

each of said edges on said pair of bosses is inclined toward an inlet port end of said pump channel.

* * * * *